United States Patent [19]

Striese et al.

[11] 4,451,071

[45] May 29, 1984

[54] ADJUSTABLE STRIKE

[75] Inventors: Jim G. Striese, Brockton, Mass.; John E. Iafret; William D. Batterson, both of Grand Blanc, Mich.

[73] Assignees: TRW Inc., Cleveland, Ohio; General Motors Corporation, Detroit, Mich.

[21] Appl. No.: 334,786

[22] Filed: Dec. 28, 1981

[51] Int. Cl.[3] ..... E05B 15/02

[52] U.S. Cl. ..... 292/341.18; 292/DIG. 38

[58] Field of Search ..... 292/341.18, 341.19, 292/340, DIG. 38, DIG. 60; 411/437

[56] References Cited

U.S. PATENT DOCUMENTS

| | | | |
|---|---|---|---|
| 1,390,519 | 9/1921 | Evans | 292/341.18 |
| 1,614,046 | 1/1927 | Schmidgall | 292/341.18 |
| 2,486,772 | 11/1949 | Wuerl | 292/341.18 |
| 2,503,536 | 4/1950 | Yeakel | 292/341.18 |
| 2,731,822 | 1/1956 | Bargman | 292/341.18 X |
| 4,158,463 | 6/1979 | Henrichs | 292/341.18 |
| 4,209,194 | 6/1980 | Poe | 292/341.18 |
| 4,288,120 | 9/1981 | Moore | 292/341.18 |

FOREIGN PATENT DOCUMENTS

| | | | |
|---|---|---|---|
| 828463 | 12/1951 | Fed. Rep. of Germany | 411/437 |

*Primary Examiner*—Gary L. Smith
*Assistant Examiner*—R. Illich

[57] ABSTRACT

An adjustable strike incorporates a bracket defining a slide, a striker plate including a latch-engaging section and an integral slider slidably positioned in the slide and an adjusting screw recessed into the bracket underneath the slide, said screw having a head accessible at an edge of the bracket and a thread threadedly engaging the slider. Projections are provided at the opposite sides of the slide which overhang the edge margins of the slider to slidably retain the slider in the slide. The bracket and screw are simple molded plastic parts and the striker plate is a simple formed metal part. All three parts can be assembled quickly without any tools by placing the screw in the bracket recess and engaging an edge of the striker plate slider under the projections at one side of the slide and pressing the slider down into the slide whereupon its opposite side edge becomes engaged under the projections at the opposite side of the slide.

23 Claims, 9 Drawing Figures

ADJUSTABLE STRIKE

This invention relates to a striker plate or strike. It relates more particularly to a strike of the type adapted to receive a latch mounted to a hinged door in order to retain the door in its closed position. One particularly useful application of the strike is in an automobile glove compartment to latch and lock the compartment door.

BACKGROUND OF THE INVENTION

In hinged door assemblies fitted with latches, it is common practice to mount a strike on the door casement opposite the latch to provide a detent for engaging and retaining the latch bolt when the door is closed. When installing a securement of this type, usually the latch is mounted to the door and the door is closed. Then the strike is positioned on the door casement opposite the latch bolt so that the bolt projects into the strike opening. The strike is then adjusted toward or away from the front of the casement so that when the door is completely closed, the latch bolt engages the front edge of the strike opening. Then the strike is fastened to the casement at that location. Resultantly, in use, the latch bolt engages the strike when the door is precisely in its fully closed position.

In any high volume production line, an auto assembly line for example, it is desirable to be able to install a part such as a glove compartment door strike at precisely the same location in the glove compartment from unit to unit. However, as will be appreciated, due to parts variations, the position of the strike relative to the glove compartment door latch will vary to some extent from one automobile to the next. If the strike fastener holes are positioned at the same locations in the glove compartments, a certain number of the strikes will be positioned at the correct location to properly latch the door. However, in a relatively large percentage of automobile bodies, the strike will be positioned too close to the front of the compartment so that the compartment door latches before it is fully closed, presenting a poor appearance and a potential source of rattles. Also, in a similarly large percentage of automobile units, the strike will be located too far away from the front of the compartment so that the door, when closed, will not latch.

To account for these dimensional variations in the various automobile parts, the strikes conventionally used by the automobile industry are provided with fastener-receiving openings in the form of slots which permit a certain amount of adjustment of the strike toward or away from the glove compartment opening as required to achieve proper door closure. However, it is difficult to mount and adjust a slotted strike in the confined space inside an automobile glove compartment. Such compartments are located close to the automobile floor and the strike must be mounted in the upper wall of the compartment, well below the installer's normal eye level. Therefore, it is quite difficult to position and manipulate a screwdriver or other tool in order to mount the strike to the compartment wall.

Also, in practice, usually two or more adjustments are required to properly position the strike. That is, after the strike is fastened loosely to the compartment wall, the proper position of the strike is estimated, the fasteners are tightened, and the door is closed. If the door fit is not quite right, the door must be opened, the fasteners loosened, the strike repositioned by an amount that the installer estimates will cause the door to latch correctly and the fasteners retightened. If his estimate is not correct, one or more additional adjustments must be made.

There have been some attempts to overcome the problem in the case of structural wooden doors by making the strikes screw-adjustable. See, for example, U.S. Pat. Nos. 2,412,497; 2,486,772 and 2,503,536. However, those adjustable strikes are relatively large and complicated and therefore expensive. Consequently, they are of limited benefit for use in high-volume applications, such as automobile production.

SUMMARY OF THE INVENTION

Accordingly, it is an object of this invention to provide an improved adjustable striker plate or strike for a hinged closure.

Another object of the invention is to provide a strike whose position on a door casement can be adjusted easily to ensure that the door latches only when fully closed.

Yet another object of the invention is to provide a strike which can be mounted to the top wall of an automobile glove compartment and whose position relative to the opening into the compartment can be adjusted from a location outside of that compartment.

A further object of the invention is to provide a strike for an automobile glove compartment which can be mounted quickly in exactly the same location in a succession of automobile bodies and be repositioned as needed to assure proper door closure, despite differences in the fit of the doors on their respective glove compartments.

Another object of the invention is to provide such a strike which can be repositioned easily after purchase by the automobile owner in the event that becomes necessary.

Another object of the invention is to provide a strike which is composed of relatively few parts which are easy and inexpensive to manufacture and assemble.

Yet another object is to provide a strike for an automobile glove compartment which can be installed and adjusted very quickly without any special tools or equipment.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present strike is constructed so that it can be mounted and adjusted easily to latch a hinged door only when the door is fully closed. Since the strike is particularly useful in connection with automobile glove compartments, we will describe the invention in that context. It should be understood, however, that the strike can retain equally well other hinged closures, particularly those associated with relatively small receptacles where direct access to the strike is difficult.

The strike is composed of only three separate easily manufactured parts, namely, a bracket for mounting to the upper wall of the glove compartment, a latch-receiving striker plate slidably mounted to the bracket and an adjusting screw rotatively positioned on the bracket and threadedly engaging the striker plate for adjustably positioning the striker plate relative to the bracket. The head of the adjusting screw is accessible at the forward or leading edge of the bracket.

One installs the strike by inserting threaded fasteners through openings in the bracket and turning them down into predrilled holes in the upper wall of the glove compartment near the compartment opening. These holes can be positioned at precisely the same locations from one automobile body to the next. Therefore, the strike can be mounted quite easily and quickly since no adjustment of the bracket relative to the glove compartment opening is required. When the bracket is mounted properly, the striker plate projects toward the glove compartment opening and the head of the adjusting screw is accessible right at that opening. Therefore, after the bracket is securely anchored to the glove compartment, the striker plate can be moved by means of the adjusting screw toward or away from the glove compartment opening so that the spring-loaded latch bolt on the glove compartment door latches to the striker plate precisely when the door is fully closed.

As will be described in more detail later, the striker plate is arranged to snap into a slide formed on the bracket after the adjustment screw is positioned on the bracket. Also as will be described later, provision is made for ensuring that the threads of the adjusting screw properly engage the striker plate during such assembly. Resultantly, the present strike can be manufactured and assembled quite easily and inexpensively as compared with prior strikes. The strike can be mounted properly in a glove compartment quite quickly and adjustably positioned to ensure that the glove compartment door closes properly. Moreover, the subsequent purchaser of the automobile can readily reposition the strike if required.

BRIEF DESCRIPTION OF THE DRAWINGS

For a fuller understanding of the nature and objects of the invention, reference should be had to the following detailed description, taken in connection with the accompanying drawings, in which.

Figure 7:
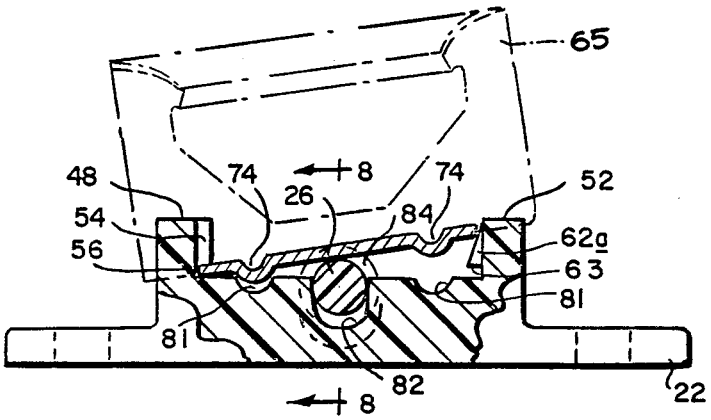
FIG. 7 is a sectional view along line 7—7 of FIG. 4 inverted and showing the strike partially assembled.

FIG., 8 is a sectional view along line 8—8 of FIG. 7; and

Figure 9:
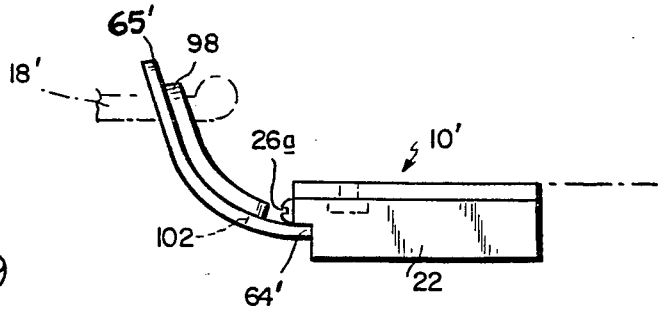

FIG. 9 is a side elevational view on a small scale showing a slightly different embodiment of the invention.

DESCRIPTION OF THE PREFERRED EMBODIMENTS

Figure 1:
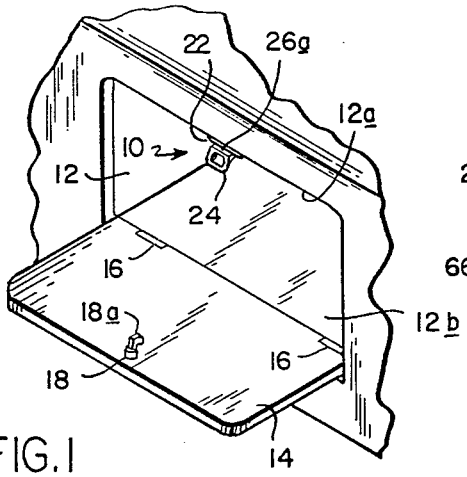
FIG. 1 is a fragmentary perspective view illustrating an automobile glove compartment equipped with a strike made in accordance with this invention.

Referring first to FIG. 1 of the drawings, the subject strike indicated generally at 10 is mounted to the top wall 12*a* of an automobile glove compartment 12. A conventional compartment door 14 is secured by hinges 16 to the compartment bottom wall 12*b*. Mounted to the door 14 near the edge thereof opposite hinges 16 is a conventional latch 18 with its spring-loaded latch bolt 18*a* being arranged to latch in the strike 10 when the door 14 is closed.

Strike 10 includes a bracket 22 which defines a slide. A striker plate 24 which is actually formed as part of a slider is positioned on the bracket and is slidable thereon toward or away from the glove compartment opening. The strike 10 also incorporates a screw 26 (FIG. 6) whose head 26*a* is located right at the compartment opening by which the position of the striker plate 24 relative to the bracket may be adjusted.

In practice, the production worker mounts the strike 10 at exactly the same location in compartment 12 in all of the cars which he is assembling. Then, after such installation, he turns the adjusting screw head 26*a* which, as shown in FIG. 1 is readily accessible in one direction or the other. In this way, he can move the striker plate 24 toward or away from the glove compartment opening so that the latch bolt 18*a* engages over the striker plate 24 only when the door is in its completely closed position. No longer is it necessary for the worker to repetitively manipulate fasteners in the cramped space inside the compartment in order to effect such adjustment. By the same token, the purchaser of the automobile can also easily adjust the striker plate 24 for proper closure in the event that becomes necessary after repeated openings and closings of the compartment door.

Figure 3:
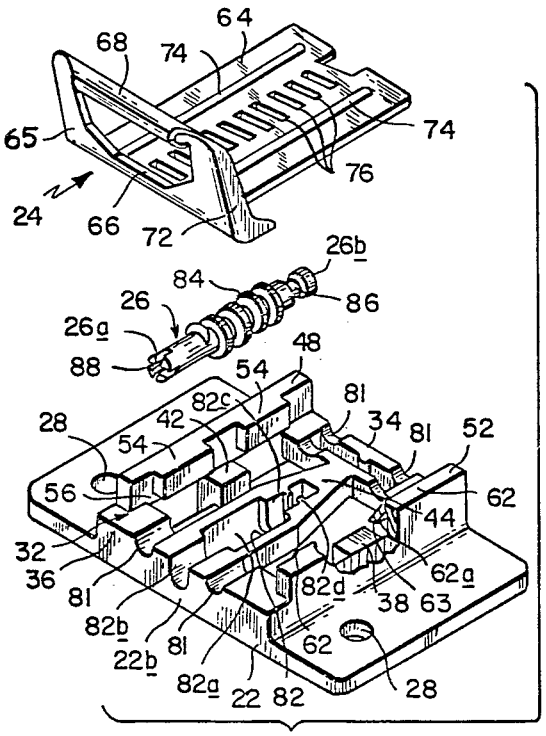
FIG. 3 is an exploded perspective view of the strike inverted.

As best seen in FIG. 3, the bracket 22 comprises a single generally rectangular part molded of a suitable impact-resistant material such as ABS or Delrin plastic. A pair of openings 28 are formed adjacent its side edges and near the front of the bracket for receiving threaded fasteners to mount the bracket to the glove compartment wall 12*a*. Formed centrally on the bracket between the aforesaid openings is a slide indicated generally at 32. Slide 32 is defined by a pair of laterally extending raised walls 34 and 36. Also positioned between these walls at the opposite ends thereof are a pair of raised pads 38 and 42. Additionally, a longitudinally extending raised boss 44 is formed between walls 34 and 36 intermediate their ends. The raised surfaces of the walls 34 and 36, the tops of pads 38 and 42 and the raised surface of the boss 44 are all coplanar so that they form a flat platform for supporting the striker plate 24 as will be described later.

Extending between the opposite ends of walls 34 and 36 are a pair of spaced-apart parallel raised ribs 48 and 52. These ribs extend above or beyond the platform-defining surfaces of those walls and they constitute the sides of the slide 32. Formed integrally with rib 48 are a pair of longitudinally spaced-apart tabs 54, which extend laterally toward rib 52. These tabs are spaced somewhat from the platform-defining surfaces of walls 34 and 36 and pad 42, thereby creating a shallow keyway 56 best seen in FIGS. 3, 5 and 7. Somewhat similar tabs 62 extend laterally from rib 52, but to a somewhat lesser extent, thereby defining a keyway 63 between those tabs and the platform-defining surfaces of walls 34 and 36 and pad 38. Moreover, the tabs 62 are provided with beveled or inclined side walls 62*a* for reasons that will become apparent later. In any event, the tabs 54 and 62 together with the aforesaid platform-defining surfaces provide the vertical constraints on the slide 32.

Figure 2:
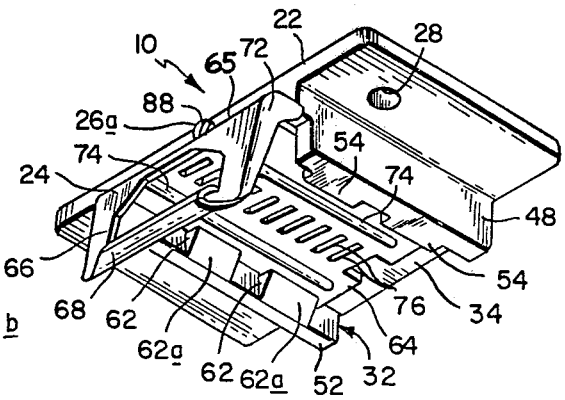
FIG. 2 is a perspective view from below on a larger scale showing the strike in greater detail.

As best seen in FIGS. 2 and 3, the striker plate 24 is a simple stamped metal part. The striker plate includes a forward section 65 which is actually the part engaged by the latch bolt 18*a* and an integral tongue or slider 64 which is the part of the striker plate that is slidably mounted to the bracket 22. Section 65 is formed with a generally trapezoidal central opening 66. The lower edge of section 65 and the lower edge of opening 66 are formed toward one another to form a generally cylindrical bearing surface 68 for the latch bolt 18*a*. In other words, when the latch 18 latches to the strike 10, the latch bolt 18*a* slides over the bearing surface 68 as it projects through opening 66. As soon as the end of the latch bolt clears surface 68, it snaps down and engages behind that surface. The side edges of the striker plate section 65 are bent back at right angles to form skirts 72. These skirts, together with the cylindrical bearing surface 68, strengthen the striker plate and prevent it from being bent by repeated engagements by the latch 18.

The tongue 64 of the striker plate is somewhat narrower than the plate section 65 and it is formed with a pair of spaced-apart longitudinal raised ribs 74 which help to rigidify the tongue. Formed in the tongue 64 between ribs 74 is a lengthwise series of parallel slots 76 which are angled somewhat with respect to the longitudinal axis of the tongue. These slots together form a gear rack which cooperates with the adjusting screw 26 to move the striker plate 24 relative to the bracket 22.

The width and thickness of the striker plate tongue 64 is such that the tongue can slide back and forth in the keyways 56 and 63 formed in the bracket 22 by the walls 34 and 36, the pads 38 and 42 and the tabs 54 and 62. In this connection, and referring to FIG. 3, the walls 34 and 36 are provided with shallow grooves 81 to slidably receive the reinforcing ribs 74 formed on the striker plate tongue. Thus when the striker plate is properly positioned in the bracket slide 32, its latch-engaging section 65 is free to slide toward and away from the leading edge 22*a* of bracket 22.

The adjusting screw 26 component of the strike 10 is positioned in a recess 82 formed in the bracket boss 44, such positioning taking place prior to the attachment of the striker plate to the bracket. The screw 26 is a generally cylindrical rod-like part molded of a rugged, impact-resistant, plastic material. The screw is formed with a relatively high helical thread 84 intermediate its ends and it has a reduced-diameter neck 86 adjacent its tail end 26*b*. The screw head 26*a* is rounded and provided with screwdriver slots 88.

Figure 8:
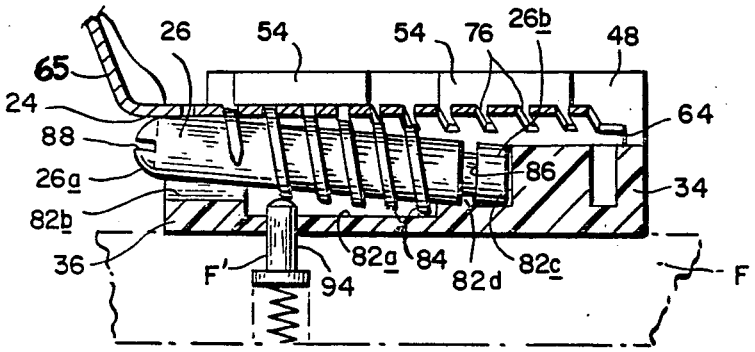

As best seen in FIGS. 3 and 8, the screw-receiving recess 82 is formed as a generally cylindrical section. It has a relatively large diameter, centrally located, lengthwise section 82*a* for accommodating the screw thread 84 and a pair of smaller diameter end segments 82*b* and 82*c* for journaling the ends of the adjusting screw. One of these segments, namely segment 82*b*, extends through the front of the bracket 22. The other segment 82*c* is formed with a reduced-diameter flange 82*d* which projects into the screw neck 86 when the screw is seated as shown in FIG. 8 to prevent axial movement of the screw relative to the bracket.

Figure 5:
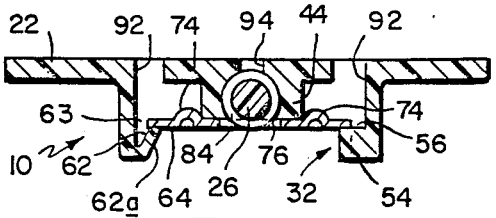
FIG. 5 is a sectional view along line 5—5 of FIG. 4.

When the screw is properly seated as shown in FIG. 5, the convolutions of the thread 84 project below the surface of the boss 44. Furthermore, the thread pitch is such that, when the striker plate is slidably positioned in the bracket slide 32, the threads 84 project a substantial distance into the slots 76 in the striker plate tongue 64 whereby those two components function more or less as a rack and pinion. In other words, when the screw 26 is turned in one direction or the other, the tongue 64 and therefore the striker plate 24 as a whole is caused to move in one direction or the other along the bracket slide 32.

Figure 4:
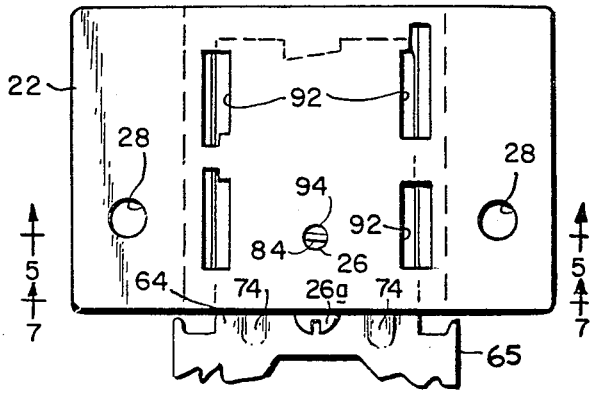
FIG. 4. is a top plan view of the strike with parts cut away.

As mentioned previously, the striker plate 24 is a simple stamped part; the screw 26 is a molded part and the third component of the strike, namely the bracket 22 is also a molded part. Despite its relatively complex configuration, the bracket can be shaped easily using conventional mating male and female draw molds. Even the flat surfaces of the bracket tabs 54 and 62 which define the slider-receiving keyways 56 and 63 can be located accurately by establishing those surfaces through openings 92 formed through the body of bracket 22 during the molding process, which openings are best shown in FIGS. 4 and 5. When the bracket 22 has set, the molds can simply be pulled apart to release the finished bracket. There is no need to use more complicated molds requiring camming or laterally retractable parts in order to release the bracket.

As the components of the strike 10 are easy to fabricate, they are equally easy to assemble. First, the adjusting screw 26 is dropped into the bracket recess 82 so that the screw neck 86 receives the recess flange 82*d* and with the head 26*a* of the screw projecting from the front of the bracket. Next, the striker plate 24 is oriented relative to the bracket so that the latch-engaging section 26 thereof is located adjacent the screw head 26*a* and extends away from the screw. After this, the side edge of striker plate tongue 64 is engaged in the keyway 56 defined by the pad 42, the adjacent ends of walls 34 and 36 and the tabs 54 as shown in FIG. 7. Following this, the opposite side edge of the tongue 64 is pressed down toward the pad 38. As noted previously, the tabs 62 extending from rib 52 have beveled or tapered side walls 62*a*. This permits the tongue edge to slide down those tabs until that edge seats in the keyway 63 adjacent those tabs. As the tongue becomes properly seated in the bracket slide, the edges of the screw thread 84 project into the slots 76 in the striker plate tongue, thereby completing the assembly process.

Figure 6:
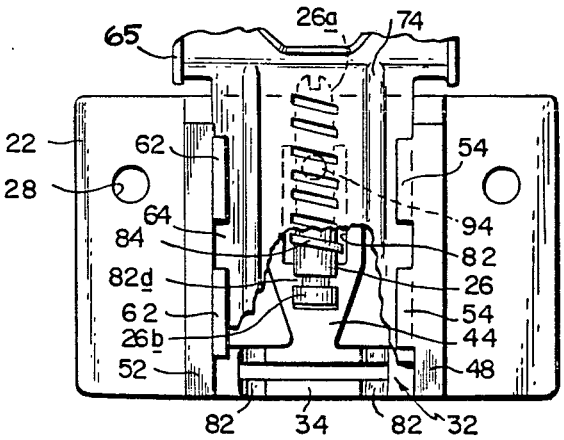
FIG. 6 is a bottom plan view of the strike with parts broken away.

In some instances when the striker plate tongue is pressed toward the keyway 63, the screw threads 84 may not be precisely aligned with the striker plate slots 76. If that should occur, the striker plate could become hung up on those threads. To avoid that potential problem, a small opening 94 is formed at the bottom of the boss recess 82 at the forward end of the section 82*a* thereof as best seen in FIGS. 4, 6 and 8. During assembly of the strike, the bracket 22 can be positioned upside down on a fixture F shown in dotted lines in FIG. 8. That fixture is provided with an upstanding pin or post illustrated at F′ which is arranged to project through the bracket opening 94. The length of the pin F′ is such that when the screw 26 is positioned in the boss recess 82, the pin F′ engages the screw and tilts its forward end upwards out of recess 82 as illustrated in that figure. Now when the assembler engages the edge of the striker plate tongue 64 in the keyway 56, he can move the tongue slightly along that keyway until the convolutions of thread 84 at the forward end of the screw, which are now raised up out of the recess 82, engage in slots 76. At that point, he knows that the screw thread 84 is aligned with the slots and he can then press the opposite edge of the tongue 64 into the keyway 63 to complete the assembly process. That last pressing operation can be performed after removing the bracket 22 from the fixture F. Alternatively, the fixture pin F′ can be made retractable as shown under the force required from the operator to seat the striker plate in the bracket slide 32.

The strike 10 illustrated in FIGS. 1 to 8 is arranged to be engaged from above by the latch plunger 18*a*. FIG. 9 illustrates a strike 10' which is shaped to be engaged from below by a latch 18'. Strike 10' is identical to strike 10 except for the configuration of the striker plate section 65' thereof which is engaged by the latch. In this embodiment, that section is bent upwardly rather than downwardly relative to its tongue 64' which is slidably received in the bracket 22. Section 65' has the usual central opening for receiving the latch bolt and it is formed with a flange 98 to rigidify that section. A bottom segment of that flange is cut away at 102 to provide horizontal access to the head 26*a* of the adjusting screw 26 which projects out of the bracket 22 as shown. The components of the strike 10' are assembled and operated in exactly the same way as described above in connection with strike 10.

To install either strike 10 or 10', the assembler simply positions the strike bracket opposite the predrilled holes in the glove compartment upper wall 12*a* as shown in FIG. 1. Then he inserts threaded fasteners through the openings 28 in the bracket and turns them down into the predrilled holes. Following this, he simply closes the glove compartment door 14. If the latch 18 engages the strike 10 properly when the door is fully closed, no further adjustment need be made. On the other hand, if the door does not latch, indicating that the striker plate 24 is recessed too far into the glove compartment opening, the installer simply rotates the screw 26 counterclockwise. That motion slides the striker plate 26 forwardly relative to the bracket. The installer can then try to close the door. If it latches when the door is fully closed, the adjustment is complete. On the other hand, if the latch latches on the strike plate before the door is fully closed, this indicates that the installer has turned the screw too far in the counterclockwise direction. Therefore, a clockwise rotation of the screw will serve to properly locate the striker plate. Usually, only one or two adjustments of the screw are required to properly position the plate. It is important to appreciate, however, that, unlike the case with conventional strikes used for this purpose, this adjustment can be made right at the front of the glove compartment and without any need at all to adjust any threaded fasteners inside the compartment. Therefore, the present strike construction should find wide application, particularly in the automotive industry.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. An adjustable strike comprising

A. a bracket,

B. means on the bracket defining a slide having a floor, (1) a recess in the floor, C. A striker plate, said plate including (1) a latch-engaging section having an opening adaped to receive a latch bolt, (2) a slider defined by a flat elongated tongue extending generally perpendicular to the plane of the latch-engaging section of the striker plate, said slider being slidably positioned in the slide so that the latch-engaging section projects from the slide, and (3) a longitudinal series of spaced parallel slots in the tongue, said slots (a) being oriented at an acute angle to the longitudinal axis of the tongue for receiving screw convolutions extending out of said bracket recess, D. an adjusting screw rotatively mounted in the recess, said screw having (1) an elongated rod-like member (2) a screw thread disposed along the rod-like member threadedly engaging the slider, said screw thread being composed of helical convolutions which project out appreciably from the surface of the member and extend out of said recess into threaded engagement with the slots in said tongue, and (3) a head accessible at an edge of the bracket adjacent the latch-engaging section for turning the screw in one direction or the other to move the striker plate in one direction or the other along the slide, and E. means at opposite sides of the slide for retaining the slider in the slide.

2. The strike defined in claim 1 wherein the latch-engaging section is disposed opposite the screw head.

3. The strike defined in claim 1 wherein the latch-engaging section extends away from the screw head.

4. The strike defined in claim 1 wherein the bracket and screw are molded of impact-resistant plastic material.

5. The strike defined in claim 1 wherein the striker plate is a stamped metal part.

6. The strike defined in claim 1 wherein the latch-engaging section of the striker plate further includes A. a lateral rib adjacent the opening for reinforcing said section, and B. a pair of webs at the opposite side edges of said section extending generally perpendicularly to the plane of said section for reinforcing said section.

7. The strike defined in claim 1 and further including

A. a pair of parallel ribs formed in the striker plate tongue at the opposite sides of the slot series, and B. spaced-apart parallel grooves formed in the floor of the bracket slide for slidably receiving said ribs.

8. The strike defined in claim 1 and further including a slot formed in the head of the adjusting screw.

9. An adjustable strike comprising

A. a bracket,

B. means on the bracket defining a slide having a floor, (1) a recess in the floor, and (2) a passage extending from the floor of the recess to the distal face of the bracket adapted to accommodate a screw raising means, C. a striker plate, said plate including (1) a latch-engaging section, (2) a slider defined by a flat elongated tongue, said slider being slidably positioned in the slide so that the latch-engaging section projects from the slide, and (3) a longitudinal series of spaced parallel slots in the tongue, said slots (a) being oriented at an acute angle to the longitudinal axis of the tongue for receiving screw convolutions extending out of said bracket recess, D. an adjusting screw rotatively mounted in the recess, said screw having
(1) an elongated rod-like member,
(2) a screw thread threadedly engaging the slider, said screw thread being composed of helical convolutions which project out appreciably from the surface of the member and extend out of said recess into threaded engagement with the slots in said tongue, and
(3) a head accessible at an edge of the bracket adjacent the latch-engaging section for turning the screw in one direction or the other to move the striker plate in one direction or the other along the slide, E. means at oppostie sides of the slide for retaining the slider in the slide, said retaining means being defined by lateral projections
(1) formed at opposite sides of the slide,
(2) being spaced from the floor of the slide,
(3) extending toward one another whereby one side edge of the striker plate tongue can be engaged under the projection at one side of the slide and the tongue pressed toward the floor of the slide to engage the other side edge of the tongue under the projection at the other side edge of the slide for slidably retaining the tongue to the bracket, whereby, a screw raising means may penetrate through the passage in said bracket to raise the screw partially out of the bracket recess when said striker plate tongue one side edge is engage under its projection so that said screw convolutions can be received in the tongue slots prior to engaging the tongue other side edge under its projection.

10. The strike defined in claim 9 wherein the said projection at the other side of said slide is formed as a ramp to facilitate seating the tongue in the slide.

11. The strike defined in claim 9 and further including passages formed in the bracket extending from the floor of the slide to the distal face of the bracket providing die access to the tongue-engaging surfaces of said projections.

12. An adjustable strike comprising

A. a bracket, said bracket being formed with
(1) a pair of spaced-apart parallel raised walls, the raised surfaces of said walls defining a plane,
(2) a raised boss extending between said walls,
(3) a recess formed in the boss, said recess extending to an edge of the bracket,
(4) a pair of raised ribs connecting the opposite ends of said walls and extending above said walls,
(5) one or more tabs formed on each said rib, each said tab
(a) being spaced above said plane, and
(b) extending laterally toward the opposite rib, B. an elongated adjusting screw, said screw
(1) having a head,
(2) having a pronounced helical thread extending along its length, and
(3) being dimensioned to fit into said bracket recess with its head being accessible at said edge of the bracket and with its thread convolutions projecting through said plane, and C. a striker plate, said plate including
(1) a latch-engaging section,
(2) a flat tongue integral with said latch-engaging section, said tongue being dimensioned to fit between said ribs in the spaces between said plane and said tabs, and
(3) a lengthwise series of slots formed in the tongue said slots being positioned to receive the thread convolutions projecting through said plane so that, when the screw is turned in one direction or the other, the striker plate slides in one direction or the other relative to the bracket.

13. The strike defined in claim 12 wherein

A. the bracket and screw are molded plastic parts, and

B. the striker plate is a formed metal part.

14. The strike defined in claim 12 and further including coacting means on the screw and in the recess for inhibiting axial movement of the screw relative to the bracket.

15. The strike defined in claim 12 wherein the raised surface of the boss also coincides with said plane.

16. The strike defined in claim 15 and further including at least one raised pad positioned between the corresponding ends of said walls, the raised surfaces of said pads also coinciding with said plane.

17. The strike defined in claim 12 wherein

A. each tab projecting from one of said ribs is, generally rectangular in cross-section, and B. each tab projecting from the other of said ribs is generally triangular in cross-section so as to form a ramp extending toward said plane.

18. The strike defined in claim 16 wherein

A. a pair of tabs projects from each said rib, and

B. The raised pad adjacent that rib is situated between said tabs.

19. The strike defined in claim 12 and further including a passage extending from the floor of said recess to the distal surface of said bracket.

20. An adjustable strike comprising:

a bracket having a pair of opposed face areas with one of said face areas defining a mounting surface, an outwardly opening longitudinal recess in the other of said face areas with a pair of spaced-apart raised walls disposed longitudinally of the adjacent to the opposite sides of said recess, each wall having an integral tab extending toward the other wall with said tabs being cooperatively disposed to define a slideway;

a striker plate including a strike portion having an area thereof adapted for engagement by a latch, an elongated thin planar slider portion angularly secured to said strike portion and slidably captured in said slideway, said slider portion including means therealong for threadedly engaging an adjusting screw;

an elongated adjusting screw disposed in said recess for allowing selective rotation of said screw about its longitudinal axis, said screw having threads disposed therealong defined by helical convolutions which extend radially outward of the outwardly open area of said recess and into said slideway in threaded communication with said striker plate engaging means, whereby said striker plate is adjustable along said slideway upon rotation of said screw; and, the tabs on said bracket walls being spaced-apart from each other laterally of said slideway a suffi-